US005264321A

United States Patent [19]

Kenney et al.

[11] Patent Number: 5,264,321

[45] Date of Patent: Nov. 23, 1993

[54] PHOTOTHERMOGRAPHIC ELEMENTS WITH NOVEL LAYER STRUCTURES

[75] Inventors: Raymond J. Kenney; Takuzo Ishida, both of Woodbury; Richard C. Cotner, Stillwater, all of Minn.

[73] Assignee: Minnesota Mining and Manufacturing Company, Saint Paul, Minn.

[21] Appl. No.: 913,806

[22] Filed: Jul. 16, 1992

[51] Int. Cl.[5] ..... G03C 8/00

[52] U.S. Cl. ..... 430/203; 430/212; 430/213; 430/214; 430/215; 430/220

[58] Field of Search ..... 430/203, 212, 213, 214, 430/215, 220, 502

[56] References Cited

U.S. PATENT DOCUMENTS

| | | | |
|---|---|---|---|
| 2,350,380 | 6/1944 | White | 430/502 |
| 2,761,791 | 9/1956 | Russell | 117/34 |
| 2,798,063 | 7/1957 | Fowler et al. | 260/80.5 |
| 3,148,061 | 9/1964 | Haas | 96/29 |
| 3,330,663 | 7/1967 | Weyde et al. | 96/94 |
| 3,445,234 | 5/1969 | Cescon et al. | 96/90 |
| 3,457,075 | 7/1969 | Morgan et al. | 96/67 |
| 3,531,286 | 9/1970 | Renfrew | 96/67 |
| 3,634,089 | 1/1972 | Hamb | 96/87 |
| 3,642,482 | 2/1972 | Williams, Jr. et al. | 96/53 |
| 3,694,204 | 9/1972 | Farney et al. | 430/203 |

(List continued on next page.)

FOREIGN PATENT DOCUMENTS

| | | |
|---|---|---|
| 1243536 | 3/1984 | Canada . |
| 52-155528 | 12/1977 | Japan . |
| 57-500352 | 2/1982 | Japan . |
| 58-058543A | 4/1983 | Japan . |
| 58-149046A | 9/1983 | Japan . |
| 58-149047 | 9/1983 | Japan . |
| 59-005239 | 1/1984 | Japan . |
| 59-165054 | 9/1984 | Japan . |
| 59-168439 | 9/1984 | Japan . |
| 837095 | 6/1960 | United Kingdom . |

OTHER PUBLICATIONS

T. H. James in *The Theory of the Photographic Process*, Fourth Ed.; MacMillan: New York, 1977; pp. 149–169.

*Research Disclosures* No. 17029.

*The Colour Index;* The Society of Dyes and Colourists: Yorkshire, England, 1971, vol. 4, p. 4437.

K. Venkataraman in *The Chemistry of Synthetic Dyes;* Academic Press; New York, 1952; vol. 2, p. 1206.

F. M. Hamer in *The Cyanine Dyes and Related Compounds;* Interscience Publishers: New York, 1964; p. 492.

F. X. Smith et al., *Tetrahedron Lett.* 1983, 24(45), 4951–4954.

X. Huang and L. Xe, *Synthetic Communications* 1986, 16(13), 1701–1707.

H. Zimmer et al., *Journal of Organic Chemistry* 1960, 25, 1234–5.

M. Sekiya et al., *Chem. Pharm. Bulletin* 1972, 20(2), 343.

T. Sohda et al., *Chem. Pharm. Bull.* 1983, 31(2), 560–5.

"Polymer Handbook", 2nd Edition (edited by J. Brandrup and E. H. Immergut, published by John Wiley and Sons, Inc.).

*Primary Examiner*—Charles L. Bowers, Jr.

*Assistant Examiner*—James Pasterczyk

*Attorney, Agent, or Firm*—Gary L. Griswold; Walter N. Kirn; Gregory A. Evearitt

[57] ABSTRACT

Various photothermographic elements are provided containing a transparent substrate; image receiving layers; dry silver layers; interlayers; and a translucent or opacifying layer. The translucent or opacifying layer can occupy a variety of positions in the photothermographic element relative to the dry silver layers. The translucent or opacifying layers serve to help produce a reflection print upon exposure of the photothermographic element to actinic light and subsequent heating of the exposed element for image development and dye transfer.

22 Claims, 1 Drawing Sheet

U.S. PATENT DOCUMENTS

| | | | |
|---|---|---|---|
| 3,700,458 | 10/1972 | Lindholm | 96/114.1 |
| 3,719,495 | 3/1973 | Lea | 96/114.1 |
| 3,756,814 | 9/1973 | Bedell | 96/3 |
| 3,761,270 | 9/1973 | deMauriac et al. | 96/77 |
| 3,764,328 | 10/1973 | Birkeland | 96/67 |
| 3,785,830 | 1/1974 | Sullivan et al. | 96/114.1 |
| 3,839,049 | 10/1974 | Simons | 96/114.6 |
| 3,928,037 | 12/1975 | DeHaes et al. | 96/29 R |
| 3,985,565 | 10/1976 | Gabrielsen et al. | 96/114.1 |
| 4,021,240 | 5/1977 | Cerquone et al. | 96/29 D |
| 4,021,250 | 5/1977 | Sashihara et al. | 96/114.1 |
| 4,022,617 | 5/1977 | McGuckin | 96/29 D |
| 4,123,274 | 10/1978 | Knight et al. | 96/66 T |
| 4,123,282 | 10/1978 | Winslow | 96/114.1 |
| 4,220,709 | 9/1980 | deMauriac | 430/353 |
| 4,260,677 | 4/1981 | Winslow et al. | 430/618 |
| 4,368,247 | 1/1983 | Fletcher, Jr. et al. | 430/17 |
| 4,374,921 | 2/1983 | Frenchik | 430/338 |
| 4,452,883 | 6/1984 | Frenchik et al. | 430/502 |
| 4,460,681 | 7/1984 | Frenchik | 430/502 |
| 4,476,220 | 10/1984 | Penfound | 430/569 |
| 4,478,927 | 10/1984 | Naito et al. | 430/203 |
| 4,483,914 | 11/1984 | Naito et al. | 430/203 |
| 4,594,307 | 6/1986 | Ishida | 430/203 |
| 5,071,740 | 12/1991 | Okauchi et al. | 430/203 |

PHOTOTHERMOGRAPHIC ELEMENTS WITH NOVEL LAYER STRUCTURES

FIELD OF THE INVENTION

This invention relates to an imageable article and in particular, it relates to a photothermographic article capable of providing a multicolored image by thermal diffusion of dyes.

BACKGROUND OF THE ART

Photothermographic imaging materials that are classified as "dry silver" compositions or emulsions comprise a light-insensitive reducible silver source; a light-sensitive silver source; and a reducing agent for the light-insensitive, reducible silver source. The light-sensitive material is generally photographic silver halide, which must be in catalytic proximity to the light-insensitive, reducible silver source. Catalytic proximity requires an intimate physical association of these two materials so that when silver specks or nuclei are generated by the irradiation or light exposure of the photographic silver halide, those nuclei are able to catalyze the reduction of the reducible silver source by the reducing agent. It has been long understood that silver halide is a catalyst for the reduction of silver ions and that the silver-generating, light-sensitive silver halide catalyst progenitor may be placed into catalytic proximity with the silver source in a number of different fashions, such as by partial metathesis of the reducible silver source with a halogen-containing source (e.g., see U.S. Pat. No. 3,457,075); coprecipitation of silver halide and reducible silver source material; (e.g., see U.S. Pat. No. 3,839,049); and other methods that intimately associate the silver halide and the silver source.

In both photographic and photothermographic emulsions, exposure of the photographic silver halide to light produces small clusters of silver atoms. The imagewise distribution of these clusters is known in the art as a latent image. As this latent image generally is not visible by ordinary means, the light-sensitive article must be further processed in order to produce a visual image. The visual image is produced by the catalytic reduction of silver ions which are in catalytic proximity to the silver halide grains bearing the latent image.

One conventional way of attempting to increase the image density of photographic and photothermographic emulsions without increasing, or while decreasing, the amount of silver in the emulsion layer is by the inclusion of dye forming materials into the emulsion. In this way a dye enhanced silver image can be produced.

Residual silver stain is a major problem with dry silver color constructions known in the art. This has been overcome by causing the developed dye image to diffuse from the dry silver layer to an image-receiving layer that is then stripped from the dry silver layer.

U.S. Pat. No. 4,594,307 discloses a heat developable photographic material that produces a pure and stable dye image by the oxidation-reduction reaction between a reducible organic silver salt and a leuco dye reducing agent wherein the dye formed is transferred to an image-receiving layer by continuing the heating for development. This separates the dye formed from the silver images and other residual chemicals.

It has been described in the patent literature to transfer a dye image formed in a photothermographic system by means of a transfer solvent; see, for example, U.S. Pat. Nos. 3,985,565; 4,021,240; and 4,022,617.

Japanese Patent Application No. 59-5239 discloses a photothermographic contact diffusion system wherein a chemical reaction occurs in an image-receiving layer between a diffused leuco dye and an acidic color developing agent.

Heat developable photographic materials for providing dye images by the reaction of color couplers with the oxidants of an organic reducing agent have been described in U.S. Pat. Nos. 3,531,286; 3,761,270; and 3,764,328. These materials suffer from the problem that the optical density of the background is increased because of the presence of unreduced silver. Poor print stability is also a problem.

Dye formation by an oxidation-reduction reaction between a reducible silver source and a leuco dye to form a visible dye is disclosed in U.S. Pat. Nos. 3,985,565; 4,022,617; and 4,460,681. However, in these processes, the materials provide turbid and hazy color images on account of the presence of the reduced silver image after heat development. Moreover, the image tends to suffer from background stain upon aging due to residual chemicals in the material. The silver images can be removed by liquid processing and the dyes can be transferred to an image-receiving layer with the aid of a transfer solvent such as alcohol.

Another process employing a heat developable photographic material to produce dye images by the oxidation-reduction reaction between an organic silver salt oxidizing agent and a dye releasing compound that releases a mobile dye when the material is heated is disclosed in Japanese Patent Application Nos. 58-58543; 58-79247; 58-149046; and 58-149047. This process requires that the dyes be transferred to an image-receiving sheet with the aid of a transfer solvent such as water.

Depending on the particular ingredients of a given dry silver layer, the development may be best carried out, for example, under acidic or basic conditions. When multiple dry silver layers with incompatible developing chemistries are employed, it is very difficult to keep development conditions within the dry silver layer from affecting the development of nearby or adjacent dry silver layers. As a result, it is advantageous to coat dry silver layers with different developing conditions on opposite sides of a transparent substrate. However under these conditions a good reflection print has not been obtained.

Opacifying layers have been employed in the wet-developed photographic art to improve the quality of reflection prints. For example, U.S. Pat. No. 3,928,037 and references cited therein describe the use of opacifying layers in diffusion transfer reversal photographic materials. Those materials are not exposed through the opacifying layer and are wet diffusion processed.

SUMMARY OF THE INVENTION

By the present invention, it has been discovered that imageable articles based on dry silver chemistry may be prepared that have a translucent layer incorporated therein. The exposure and subsequent thermal processing are conducted through the translucent layer, thereby rendering a reflection print.

In one embodiment, the present invention provides an imageable article comprising a transparent substrate having first and second major substrate surfaces, wherein the first major substrate surface comprises the following layers sequentially coated thereon: an image-receiving layer; a strippably adhered first dry silver layer; an interlayer; and a second dry silver layer; and wherein the second major substrate surface comprises the following layers sequentially coated thereon: an image-receiving layer; a translucent layer; and a third dry silver layer. In a preferred embodiment, the third dry silver layer is strippably adhered. Additionally, protective layers on the outside of the coated first and second major substrate surfaces of the imageable article are preferably utilized.

In another embodiment, the present invention provides an imageable article comprising a transparent substrate having first and second major substrate surfaces, wherein the first major substrate surface comprises the following layers sequentially coated thereon: an image-receiving layer; and a strippably adhered first dry silver layer; and wherein the second major substrate surface comprises the following layers sequentially coated thereon: an image-receiving layer; a translucent layer; a second dry silver layer; an interlayer; and a third dry silver layer. In a preferred embodiment, the second dry silver layer is strippably adhered. Additionally, protective layers on the outside of the coated first and second major substrate surfaces of the imageable article are preferably utilized.

By the present invention, it has also been discovered that imageable articles based on dry silver chemistry may be prepared that have an opacifying layer incorporated therein.

Thus, in a further embodiment the present invention provides an imageable article comprising a transparent substrate having one major substrate surface thereof comprising the following layers sequentially coated thereon: an image-receiving layer; an opacifying layer; a first dry silver layer; a barrier interlayer; a second dry silver layer; an interlayer; and a third dry silver layer. In a preferred embodiment, a protective layer is positioned on the outside of the coated major substrate surface of the imageable article, i.e., over the third dry silver layer.

The first, second, and third dry silver layers of each imageable article are typically sensitized to light of different wavelengths such as green, red, and blue.

In still other embodiments, the present invention provides processes for making reflective print images comprising the steps of: (a) exposing an imageable article (i.e., one of the foregoing disclosed embodiments of the present invention) to actinic light; (b) heating the resulting exposed article for image development and transfer; and (c) stripping the strippably adhered dry silver layers from the image-receiving layers. Preferably, the heating step takes place at a temperature in the range of about 80° to 250° C. for about 0.5 sec. to 300 sec.

As used herein:

"Strippably adhered" means, as is well understood in the art, that the layers are sufficiently well adhered to each other to survive mild handling without the layers separating and yet still be separable from each other by hand or mechanical device when required without tearing of individual layers. This generally means that a peel force (delaminating resistance) of about 1 to 50 g/cm width (0.1 to 4.5 ounces per inch width) of layer is needed to separate the two layers when one layer is pulled at 180° from the other at about 127 mm (5 inches) per minute.

"Dry silver layer" means a layer of an imageable article of this invention which contains light-sensitive silver halide (e.g., silver chloride); light-insensitive, reducible, silver source material (e.g., silver behenate); and reducing agent for the light-insensitive, reducible silver shource material (e.g., leuco dye).

"Translucent layer" means a layer of colored material(s), such as titanium dioxide pigment, that will both reflect and transmit light. Typically, about 5–45% of the incident light will be transmitted through the layer containing the colored material(s).

"Opacifying layer" means a layer containing a material, such as titanium dioxide, at a high enough concentration level such that virtually no light (e.g., less than 5% visible radiation) is transmitted through the layer of material.

When the imageable materials of this invention are imagewise exposed to light and developed by heat, an oxidation-reduction reaction occurs between a reducible silver source (e.g., silver behenate) and reducing agent (e.g., leuco dye) in each emulsion layer. The dyes formed in each emulsion layer, for example, magenta dye in the green sensitive layer, yellow dye in the blue sensitive layer; and cyan dye in the red sensitive layer, then migrate through the interlayers and the emulsion layers to the image-receiving layer as the photothermographic article is heated for development.

Dye formation and dye transfer can be carried out without the aid of any transfer solvent or wet chemicals. After development by heat, the imageable photothermographic element, which is strippably adhered to the image-receiving layer or translucent or opacifying layer, can be peeled away from the image-receiving layer and discarded.

Other aspects, advantages, and benefits of the present invention are apparent from the detailed description, drawings, examples, and claims.

DETAILED DESCRIPTION OF THE INVENTION

Figure 1:
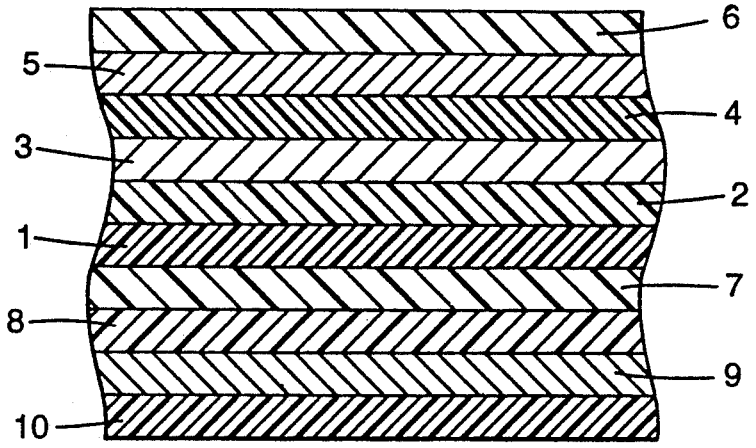
FIG. 1 is a cross-sectional view of an imageable article of one embodiment of the present invention.

Referring to FIG. 1, an imageable article according to one embodiment of the present invention comprises a transparent substrate 1 having first and second major substrate surfaces. Sequentially coated on the first major substrate surface are an image-receiving layer 2; a strippably adhered first dry silver layer 3; an interlayer 4; a second dry silver layer 5; and an optional protective layer 6. On the second major substrate surface of the transparent substrate are sequentially coated an image-receiving layer 7; a translucent layer 8; a third dry silver layer 9; and an optional protective layer 10.

Figure 2:
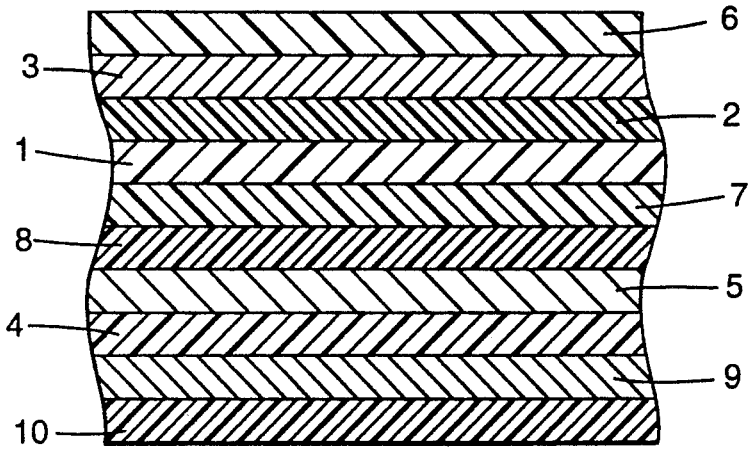
FIG. 2 is a cross-sectional view of an imageable article of another embodiment of the present invention.

In another embodiment, referring to FIG. 2, an imageable article of the present invention comprises a transparent substrate 1 having first and second major substrate surfaces having sequentially coated on the first surface an image-receiving layer 2, a strippably-adhered first dry silver layer 3, and an optional protective layer 6. The second major substrate surface of the transparent substrate is sequentially coated with an image-receiving layer 7; a translucent layer of titanium dioxide 8, a second strippably adhered dry silver layer 5; an interlayer 4; a third dry silver layer 9, and an optional protective layer 10.

Figure 3:
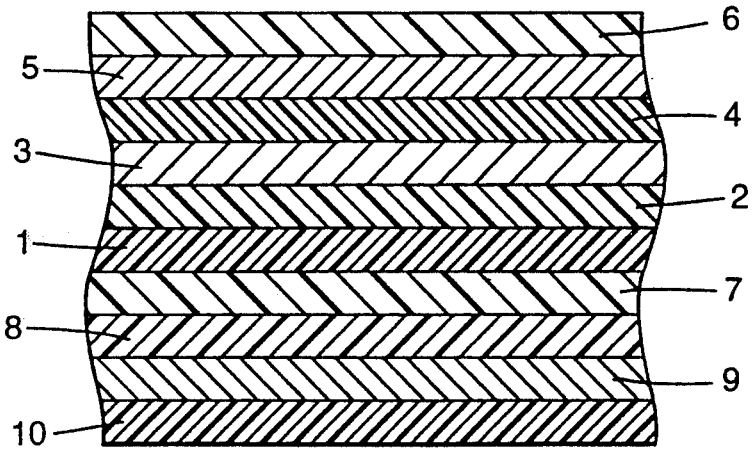
FIG. 3 is a cross-sectional view of one preferred embodiment of an imageable article of the present invention.

In one preferred embodiment of the present invention corresponding to FIG. 3, a transparent substrate 1 having first and second major substrate surfaces has sequentially coated on the first substrate surface an image-receiving layer 2; a green sensitive dry silver layer 3; an interlayer 4; a blue sensitive dry silver layer 5; and an optional protective layer 6. The second surface of the transparent substrate is sequentially coated with an image-receiving layer 7; a translucent layer of titanium dioxide 8; a red sensitive dry silver layer 9; and an optional protective layer 10.

The imageable articles of the present invention may be exposed to actinic light from either surface and are viewed from the substrate side having the first surface.

SUBSTRATE

Support bases or substrates of the photothermographic article of this invention can be transparent (optically clear) supporting material, such as polymeric films or glass. Preferably, the support comprises a thermoplastic resin, e.g., polyesters such as polyethylene or poly(ethylene terephthalate); cellulosics such as cellulose acetate, cellulose butyrate, cellulose acetate butyrate, and cellulose propionate; polyolefins such as polystyrene; polyvinyl resins such as poly(vinyl chloride) and poly(vinyl acetate); copolymeric vinyl resins such as copolymers of vinyl chloride and vinyl acetate; copolymers of vinylidene chloride and acrylonitrile; and copolymers of styrene and acrylonitrile. It is also desirable to employ a support that can also function as an image-receiving layer. Combinations of resins (binders) are also useful. It is preferred that the image-receiving layer and optional support base be flexible to facilitate stripping.

It is preferred that the substrate used for the light-sensitive material in the present invention is one that has good dimensional stability at the processing temperature. The polyesters described in U.S. Pat. No. 3,634,089 are preferably used. More preferably, a polyethylene terephthalate film is used.

The substrate may be surface treated to modify adhesion or coatability, or may be coated with one or more subbing layers, and may be from about 1 mm to 1 μm in thickness, preferably from about 4 μm to 0.3 mm in thickness.

IMAGE-RECEIVING LAYER

Image-receiving layers according to the present invention may be made from any flexible or rigid, transparent (optically clear) thermoplastic resin. The layer thickness should preferably be at least 0.1 micrometer, more preferably from about 1 to about 10 micrometers, and preferably has a glass transition temperature ($T_g$) in the range of about 20° to 200° C. so that it can withstand the conditions expected in photothermographic processing. Any thermoplastic resin or combination of thermoplastic resins capable of absorbing and fixing the dyes can be used. The resin acts as a dye mordant. No additional fixing agents are required, although they can be used, if desired. Preferably, the polymeric resin in the image-receiving layer is impermeable to the solvent used for coating the first dry silver layer and is incompatible with the material of the polymeric binder used for the first dry silver layer. Incompatible polymers will adhere poorly to each other and will provide good strippability of the dry silver layers from the image-receiving layer.

Non-limiting examples of organic polymeric materials useful in the dye receiving material of this invention include polystyrene having a molecular weight of 2,000 to 85,000, polystyrene derivatives having substituents with not more than 4 carbon atoms, polyvinyl cyclohexene, polydivinylbenzene, polyvinylpyrrolidone, polyvinylcarbazole, polyallylbenzene, polyvinylalcohol, polyacetals such as polyvinyl formal and polyvinyl butyral, polyvinyl chloride, chlorinated polyethylene, polytrifluoroethylene, polyacrylonitrile, poly(N,N-dimethylallylamide), polyacrylates having a p-cyanophenyl group, a pentachlorophenyl group or a 2,4-dichlorophenyl group, poly(acryl chloroacrylate), poly(methyl methacrylate), poly(ethyl methacrylate), poly(propyl methacrylate), poly(isopropyl methacrylate), poly(isobutyl methacrylate), poly(tert-butyl methacrylate), poly(cyclohexyl methacrylate), polyethylene glycol dimethacrylate, poly(cyanoethyl methacrylate), polyesters such as polyethylene terephthalate, polysulfone bisphenol A polycarbonate, polycarbonates, polyanhydrides, polyamides, and cellulose acetate. The synthetic polymers described in *Polymer Handbook*, 2nd Edition (edited by J. Brandrup and E. H. Immergut, published by John Wiley and Sons, Inc.) are also useful. These polymeric substances may be used singly or a plurality of them may be used in the form of a copolymer or polymer blend.

Preferred thermoplastic resins that can be used to prepare the image-receiving layer include polyesters such as polyethylene terephthalate; cellulosics such as cellulose acetate, cellulose butyrate, and cellulose propionate; polystyrene; poly(vinyl chloride); poly(vinyl acetate); copolymers of vinyl chloride and vinyl acetate; copolymers of vinylidene chloride and acrylonitrile; and copolymers of styrene and acrylonitrile.

The image-receiving layer can be applied to a support base or substrate by various coating methods known in the art such as curtain coating; extrusion coating; dip coating; air-knife coating; hopper coating; or by any other coating method used for solution coating. After coating, the image-receiving layer is dried (e.g., in an oven) to remove the solvent. Commonly used solvents include methyl ethyl ketone, acetone, and tetrahydrofuran.

Dyes generated during thermal development of light-exposed regions of the dry silver layers migrate under development conditions into a dye receiving layer where they are retained. The dye receiving layer may be composed of a polymeric material having affinity for the dyes employed. Necessarily, it will vary depending on the ionic or neutral characteristics of the migrating dyes.

DRY SILVER LAYERS

Dry silver layers utilized in the present invention comprise an intimate mixture of a light-sensitive silver halide; another silver compound such as a silver salt of an organic acid (e.g., silver behenate, silver benzimidazolate, or silver saccharine) which upon reduction gives a visible change and which is substantially light-insensitive (i.e., a reducible silver source), and a reducing agent. In the case of dry silver compositions capable of producing a colored imaged, a leuco dye, which forms a colored dye when oxidized, is generally used as the reducing agent. When it is desirable to have sensitivity of the dry silver composition to visible light, a spectral sensitizer is additionally incorporated.

Such a mixture is usually prepared in a solvent as a dispersion that is spread as a layer on a suitable substrate, for example by separately forming a silver halide and an organic silver salt oxidizing agent and mixing them before use. It is also effective to mix the two in a ball mill for a long time. Another effective method comprises adding a halogen-containing compound to the prepared organic silver salt oxidizing agent and forming silver halide by the reaction of the halogen-containing compound with silver in the organic silver salt oxidizing agent. When combined with the other layers of the present invention, the dry silver layer is exposed to a light image and thereafter, a reproduction of the image is developed by heating the coated substrate.

Dry silver layers utilized in the invention may comprise a single coated layer or a plurality of sequentially coated sublayers containing the various constitutent components. In cases where the imaging layers comprise a plurality of sublayers, the sublayer containing the silver halide is referred to as a dry silver layer.

SILVER HALIDE

The silver halide can be any photosensitive silver halide, such as silver bromide, silver iodide, silver chloride, silver bromoiodide, silver chlorobromoiodide, silver chlorobromide, etc., and can be added to the dry silver layer in any manner so as to place it in catalytic proximity to the silver source. The silver halide is generally present at a concentration of from about 0.01 to about 15 percent by weight of the dry silver layer. It is preferred to use from about 0.1 to about 10 percent by weight silver halide in the dry silver layer and more preferred to use from about 0.1 to about 2.0 percent by weight.

The silver halide used in the present invention may be used as is. However, it may be chemically sensitized with a chemical sensitizing agent such as compounds of sulfur, selenium, tellurium, etc.; compounds of gold, platinum, palladium, rhodium, iridium, etc.; a reducing agent such as tin halide, etc.; or a combination thereof. Details thereon are described in James, T. H. *The Theory of the Photographic Process*, Fourth Ed.; MacMillan: New York, 1977; pp. 149–169.

The silver halide used in the present invention can be spectrally sensitized with methine dyes, polymethine dyes, or other dyes. Suitable dyes that can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes, and complex merocyanine dyes are particularly useful.

LIGHT-INSENSITIVE, REDUCIBLE SILVER SOURCE

The light-insensitive, reducible silver source material, as mentioned previously, can be any material that contains a reducible source of silver ions. Silver salts of organic aliphatic acids, particularly long chain aliphatic carboxylic acids (e.g., having from 10 to 30, preferably from 15 to 28, carbon atoms) are preferred. Complexes of organic or inorganic silver salts wherein the ligand has a gross stability constant for silver ion of between 4.0 and 10.0 are also desirable. The reducible silver source material should constitute from about 5 to about 70 percent by weight of each dry silver layer, and preferably from about 5 to 25 weight percent.

Organic silver salts that can be used in the present invention are silver salts which form a silver image by reacting with the above described leuco compound or an auxiliary developing agent that is coexisting with the leuco compound, if desired, when it is heated to a temperature of above 80° C., and preferably above 100° C., in the presence of exposed silver halide. Suitable organic silver salts include silver salts of organic compounds having a carboxyl group. Preferred examples thereof include silver salts of aliphatic and aromatic carboxylic acids. Preferred examples of silver salts of aliphatic carboxylic acids include silver behenate, silver stearate, silver oleate, silver laurate, silver caproate, silver myristate, silver palmitate, silver maleate, silver fumarate, silver tartarate, silver linoleate, silver butyrate and silver camphorate, mixtures thereof, etc. Silver salts that are substituted with a halogen atom or a hydroxyl group can also be effectively used. Preferred examples of silver salts of aromatic carboxylic acids and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, etc., silver gallate, silver tannate, silver phthalate, silver terephthalate, silver salicylate, silver phenylacetate, silver pyromellitate, silver salts of 3-carboxymethyl-4-methyl-4-thiazoline-2-thiones or the like as described in U.S. Pat. No. 3,785,830; and silver salts of aliphatic carboxylic acids containing a thioether group as described in U.S. Pat. No. 3,330,663. Silver salts of compounds containing mercapto or thione groups and derivatives thereof can be used. Preferred examples of these compounds include silver3-mercapto-4-phenyl-1,2,4-triazolate; silver2-mercaptobenzimidazolate; silver2-mercapto-5-aminothiadiazolate; silver2-(S-ethylglycolamido)benzothiazolate; silver salts of thioglycolic acids such as silver salts of S-alkyl thioglycolic acids (wherein the alkyl group has from 12 to 22 carbon atoms); silver salts of dithiocarboxylic acids such as silver dithioacetate, silver thioamidoate, silver 1-methyl-2-phenyl-4-thiopyridine-5-carboxylate, silver triazinethiolate, silver 2-sulfidobenzoxazole; and other silver salts such as described in U.S. Pat. No. 4,123,274. Furthermore, silver salts of a compound containing an amino group can be used. Preferred examples of these compounds include silver salts of benzotriazoles, such as silver benzotriazolate; silver salts of alkyl-substituted benzotriazoles such as silver methylbenzotriazolate, etc.; silver salts of a halogen-substituted benzotriazoles such as silver 5-chlorobenzotriazolate, etc.; silver salts of carboimidobenzotriazoles, etc.; silver salts of 1,2,4-triazoles and 1-H-tetrazoles as described in U.S. Pat. No. 4,220,709; silver salts of imidazoles; and others as disclosed in U.S. Pat. No. 4,260,677.

The silver halide and the organic silver salt that form a starting point of development should be in reactive association (i.e., in the same layer, in adjacent layers, or in layers separated from each other by an intermediate layer having a thickness of less than 1 micron). It is preferred that the silver halide and the organic silver salt are present in the same layer.

A suitable coating amount of the light-sensitive silver halide and the organic silver salt employed in the present invention is preferably in a total from 50 mg to 10 g/m$^2$ calculated as an amount of silver as disclosed, for example, in U.S. Pat. No. 4,478,927.

LEUCO DYE

The leuco dye can be any colorless or lightly colored compound that can be oxidized to a colored form, when heated in the presence of an oxidizing agent, preferably at a temperature of from about 80° C. to about 250° C. (176° to 482° F.) for a time period of from about 0.5 to about 300 seconds and can diffuse through dry silver layers and interlayers into the image-receiving layer of the article of the invention. Any leuco dye capable of being oxidized by silver ion to form a visible dye image can be used in the present invention. Compounds that are both pH sensitive and oxidizable to a colored state are useful, but not preferred, while compounds sensitive only to changes in pH are not included within the term "leuco dyes" because they are not oxidizable to a colored form. Representative classes of leuco dyes suitable for use in the present invention include, but are not limited to, biphenol leuco dyes, phenolic leuco dyes, indoaniline leuco dyes, acrylated azine leuco dyes, phenoxazine leuco dyes, phenodiazine leuco dyes, and phenothiazine leuco dyes. Also useful are leuco dyes such as those disclosed in U.S. Pat. Nos. 3,445,234; 4,021,250; 4,022,617; and 4,368,247; and Japanese Patent Application No. 57-500352. Preferred dyes are described in U.S. Pat. No. 4,460,681, incorporated herein by reference. The density of the dye image and even the color of the dye image in the image-receiving layer is very much dependent on the resin of the image-receiving layer which acts as a dye mordant and as such is capable of absorbing and fixing the dyes. A dye image having a reflection optical density (ROD) in the range of from 0.3 to 3.5 (preferably from 1.5 to 3.5) or a transmission optical density (TOD) in the range of from 0.2 to 2.5 (preferably from 1.0 to 2.5) can be obtained with the present invention. The leuco dye can be present in a dry silver layer in the range of from about 1 to about 20 percent by weight, and preferably from about 3 to about 15 percent by weight.

Suitable leuco dyes for use in the present invention are compounds that oxidize to form a dye image. In the typical practice of the present invention at least one imaging layer will comprise a leuco form of a cationic dye and at least one other imaging layer will comprise a leuco form of a neutral dye.

Preferred neutral leuco dyes are phenolic leuco dyes such as 2-(3,5-di-t-butyl-4-hydroxyphenyl)-4,5-diphenylimidazole or bis(3,5-di-t-butyl-4-hydroxyphenyl)phenylmethane. Some phenolic leuco dyes useful in practice of the present invention are disclosed in U.S. Pat. Nos. 4,374,921; 4,460,681; 4,594,307; and 4,780,010, which are incorporated herein by reference.

The dyes formed from the leuco dye in the various color-forming layers should of course be different. A difference of at least 60 nm in reflective maximum absorbance is preferred. More preferably, the absorbance maximum of dyes formed will differ by at least 80–100 nm. When three dyes are to be formed, two should preferably differ by at least these minimums and the third should preferably differ from at least one of the other dyes by at least 150 and more preferably by at least 200 nm. Any leuco dye capable of being oxidized by silver ion to form a visible dye is useful in the present invention as previously noted. Leuco dyes such as those disclosed in U.S. Pat. Nos. 3,442,224; 4,021,250; 4,022,617 and 4,368,247 are also useful in the present invention.

Other leuco dyes may be used in imaging layers as well, such as, for example, benzylidene leuco compounds cited in U.S. Pat. No. 4,923,792, incorporated herein by reference. The reduced form of the dyes must absorb less strongly in the visible region of the electromagnetic spectrum and be oxidized by silver ions back to the original colored form of the dye. Benzylidene dyes have extremely sharp spectral characteristics giving high color purity of low gray level. The dyes have large extinction coefficients, typically on the order of $10^4$ to $10^5$, and possess good compatibility and heat stability. The dyes are readily synthesized and the reduced leuco forms of the compounds are very stable.

The dyes generated by the leuco compounds employed in the elements of the present invention are known and are disclosed, for example, in *The Colour Index*; The Society of Dyes and Colourists: Yorkshire, England, 1971; Vol 4, p. 4437; Venkataraman, K. *The Chemistry of Synthetic Dyes*; Academic Press: New York, 1952; Vol. 2, p. 1206; and Hamer, F. M. *The Cyanine Dyes and Related Compounds*; Interscience Publishers: New York, 1964; p. 492; and U.S. Pat. No. 4,478,927.

The leuco compounds may readily be synthesized by techniques known in the art. There are many known methods of synthesis from precursors since the reaction is a simple two step hydrogen reduction. Suitable methods are disclosed, for example, in F. X. Smith et al. *Tetrahedron Letters* 1983, 24(45), 4951–4954; X. Huang. L. Xe, *Synthetic Communications* 1986, 16(13) 1701–1707; H. Zimmer et al. *Journal of Organic Chemistry* 1960, 25, 1234–5; M. Sekiya et al. *Chem. Pharm. Bull.* 1972, 20(2), 343; Ibid 1974, 22(2), 448; and T. Sohda et al. *Chem. Pharm. Bull.* 1983, 31(2) 560–5.

Further, as other image forming materials, materials where the mobility of the compound having a dye part changes as a result of an oxidation-reduction reaction with silver halide, or with an organic silver salt at high temperature, can be used as described in Japanese Patent Application No. 165054 (1984). Many of the above described materials are materials wherein an imagewise distribution of mobile dyes corresponding to exposure is formed in the light-sensitive material by heat development. Processes of obtaining visible images by transferring the dyes of the image to a dye fixing material (diffusion transfer) have been described in Japanese Patent Application Nos. 168,439 (1984) and 182,447 (1984).

When the heat developable light-sensitive material used in this invention is heat developed in a substantially water-free condition, after or simultaneously with imagewise exposure, a mobile dye image is obtained simultaneously with the formation of a silver image either in exposed areas or in unexposed areas with exposed light-sensitive silver halide.

OPTIONAL DEVELOPMENT MODIFIER

The development temperature of dry silver layers of the invention may be influenced by the addition of development modifiers to the dry silver layer or another layer from which the development modifier may diffuse to the dry silver layer under development conditions. Development modifiers that are present at a concentration in the dry silver layer in a range of from about 0.01 to about 20 percent by weight of the dry silver layer are preferred. Representative development modifiers include aromatic carboxylic acids and their anhydrides such as phthalic acid, 1,2,4-benzenetricarboxylic acid, 2,3-naphthalenedicarboxylic acid, tetrachlorophthalic acid, 4-methylphthalic acid, homophthalic acid, 4-nitrophthalic acid, phenylacetic acid, naphthoic acid, naphthalic acid, phthalic anhydride, naphthalic anhydride, tetrachlorophthalic anhydride, and the like.

Development modifiers such as phthalazinone and both phthalazine and phthalic acid, or derivatives thereof and others known in the art, are not essential to the dry silver layer, but can be used if desired. These materials can be present, for example, in concentrations ranging from about 0.01 to about 20 percent by weight of the dry silver layer.

The components of the dry silver layer, that is, the light-sensitive silver halide, reducible silver source, and leuco dye used in the present invention are generally added to a binder as described below.

The binder for the dry silver layers may be selected from well-known natural and synthetic resins such as gelatin, poly(vinyl acetal), poly(vinyl chloride), poly(vinyl acetate), cellulose acetate, ethyl cellulose, polyolefins, polyesters, polystyrene, polyacrylonitrile, polycarbonates, methacrylate copolymers, maleic anhydride ester copolymers, copolymers of butadiene and styrene, and the like. Copolymers, terpolymers, and blends of polymers that include the above-mentioned resins are also included in these definitions. The preferred binder for the dry silver layers is poly(vinyl butyral). The binders are generally used in a concentration ranging from about 10 to about 90 percent by weight of each layer and preferably from about 30 to about 80 percent by weight.

The binder(s) that can be used in the present invention can be employed individually or as a combination thereof. The binder may be hydrophilic or hydrophobic. A typical hydrophilic binder is a transparent or translucent hydrophilic colloid, examples of which include a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic material.

The coating amount of the binder used in the present invention is 20 g or less per $m^2$; preferably 10 g or less per $m^2$; and more preferably 7 g or less per $m^2$.

The various layers employed in the present invention may contain inorganic or organic hardeners. It is possible to use chromium salts such as chromium alum, chromium acetate, etc.; aldehydes such as formaldehyde, glyoxal, glutaraldehyde, etc.; N-methylol compounds such as dimethylolurea, methylol dimethylhydantoin, etc.; dioxane derivatives such as 2,3-dihydroxydioxane, etc.; active vinyl compounds such as 1,3,5-triacryloylhexahydro-s-triazine, 1,3-vinylsulfonyl-2-propanol, etc.; active halogen compounds such as 2,4-dichloro-6-hydroxy-s-triazine, etc.; mucohalogenic acids such as mucochloric acid, mucophenoxychloric acid, etc.; polyfunctional isocyanates such as methylene diisocyanate (MDI), toluene diisocyanate (TDI), hexamethylene diisocyanate (HDI), and the like which may be used individually or as a combination thereof.

While not required, it is often desirable to modify the dry silver layer and/or the interlayers with additional ingredients, such as, for example, antihalation dyes, acutance dyes, coating aids, stabilizers, and surfactants.

The dry silver layer adjacent to the image-receiving layer can also include additives to improve the strippability of the photothermographic element, e.g., fluoroaliphatic polyesters dissolved in ethyl acetate (Fluorad FC431 TM, Minnesota Mining and Manufacturing Company, St. Paul, Minn. These additives can be added in an amount in the range of from about 0.02 to about 0.5 percent by weight of the dry silver layer, preferably from about 0.1 to about 0.3 percent by weight. Alternatively, an additive to enhance strippability can be added to the image-receiving layer in the same concentration range. No solvents need to be used in the stripping process. The layer of the strippable portion of the photothermographic element in contact with the image-receiving layer typically has a delaminating resistance of 1 to 50 g/cm (based on 180° peel) and a cohesive strength greater than, and preferably at least two times greater than, its delaminating resistance.

INTERLAYER

Polymers that exhibit both permeability to dyes at elevated development temperatures and also solubility in some solvents, but impermeability to dyes at ambient temperatures and insolubility in other solvents, can form the interlayers in the element of the present invention.

The polymer of the interlayer is preferably a thermoplastic polymer. Homopolymers of vinyl chloride or copolymers of vinyl chloride, preferably having a glass transition temperature greater than 80° C., for example, a copolymer of vinyl chloride (96 percent) and vinyl acetate (4 percent) and a blend of poly(vinyl chloride) (90 percent) and poly(vinyl acetate) (10 percent), can be used to form the interlayer. These polymers are impermeable to lower alcohols, such as methanol, ethanol, propanol, isopropyl alcohol, butyl alcohol, and ether alcohols, such as methoxypropanol, ethoxypropanol, etc. Homopolymers and copolymers of vinylidene chloride, including copolymers of vinylidene chloride with styrene, poly(vinyl pyrrolidone), or acrylonitrile are also useful as interlayers. The second dry silver layer is coated onto the first interlayer. The second dry silver layer contains the same classes of ingredients as does the first dry silver layer; the specific identity of these ingredients can vary.

PROTECTIVE LAYER

The dye diffusive dry silver photothermographic elements of the present invention may be optionally overcoated with a protective coating. Suitable materials for the protective coating include, but are not limited to, polymers that are insoluble in aqueous systems, soluble in some organic solvents, and impervious to certain other organic solvents. The protective layer, which is the outer layer and may contain developing aids such as, for example, carboxylic acids, more particularly aryl carboxylic acids, is normally a methyl methacrylate polymer (preferably a hard polymer with a Tukon hardness of 20 or more), copolymer, or blend with other polymers or copolymers (for example co-polymers with n-butyl acrylate, butyl methacrylate, and other acrylates such as acrylic acid, methacrylic acid, acrylic anhydride, and the like), polystyrene, a combination of a polyvinyl chloride terpolymer with a butadiene-styrene copolymer, or cellulosic polymers and blends such as cellulose acetate. The barrier layer may also be crosslinked. This would preferably be done by the inclusion of a latent or activatable crosslinking agent. Crosslinking could then be effected after coating.

TRANSLUCENT LAYER

The translucent layer employed in the present invention allows the dye image that results on development of the exposed photothermographic article to be viewed as a reflection print. This is of particular need since the requirement for a transparent substrate eliminates the possibility of using reflective fillers in the substrate, yet the translucent layer must not be so optically opaque that insufficient light can penetrate into the dry silver layer below. Thus, the translucent layer should be reflective as well as transmissive. Typically, only about 5–45% of the incident light will be transmitted through the layer containing the translucent material.

The translucent layers used in the present invention preferably comprise an inorganic pigment that is essentially white. Preferred pigments are those known in the photographic art for use in reflection print substrates and include, but are not limited to, titanium dioxide, barium sulfate, aluminum oxide, and the like. Titanium dioxide is a particularly preferred pigment. The pigments should be finely divided, typically having an average diameter of 0.1 to 3.5 microns, preferably 0.35 to 1.5 microns, and are dispersed in a polymeric binder. Suitable binders are those useful as interlayers in the present invention.

The thickness and density of the translucent layer should be adjusted so that the absorbance is at least about 0.10, but less than about 1.8. Preferably, the absorbance of the opacifying layer is from about 0.35 to 1.3.

The translucent layer should have good adhesion to the image receiving layer coated on the second side of the substrate to allow for good viewing of a reflection print. The dry silver layer coated on the back side must be strippably adhered to the opacifying layer to allow for clean removal following exposure, development, and transfer of the dye image to the image-receiving layer.

In accordance with the present invention, there will be some instances where an opacifying rather than translucent layer should be used. Virtually no light should be transmitted through the opacifying layer. Generally, the same type of pigments can be employed in the opacifying layer as employed in the translucent layer, however, the concentration and thickness of the opacifying layer will have to be adjusted accordingly.

Photothermographic articles of this invention preferably emply a three-color system of yellow, magenta, and cyan dye forming images. Dyes of these colors are formed by the heat-induced oxidation-reduction reaction between a light-insensitive, reducible silver source and a chromogenic leuco dye reducing agent for the silver source by means of light-exposed silver halide. A two-color system is coated on one side and a third color is coated on the other side of a transparent or transparent substrate. One interlayer is needed to separate two dye-forming dry silver layers.

The photographic dry silver layer and other hydrophilic colloid layers that are used in the light-sensitive material of the present invention may contain surface active agents for various purposes, for example, as coating aids or for prevention of electrical charging, improvement of lubricating properties, emulsification, prevention of adhesion, improvement of photographic properties (for example, acceleration of development providing hard tones or sensitization), etc. For example, it is possible to use nonionic surface active agents such as saponin (steroid), alkylene oxide derivatives (for example, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkyl amines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxyl group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkyl phenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkyl betaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a repeating unit of ethylene oxide in their molecules are often preferably incorporated into the light-sensitive material. It is particularly preferred that the molecule contains 5 or more of the recurring units of ethylene oxide. The polyethylene glycol type nonionic surface active agents are generally used in an amount of less than 100 percent by weight, preferably less than 50 percent by weight, based on hydrophilic binder present.

The light-sensitive material used in the present invention may contain, if desired or necessary, various additives known for heat developable light-sensitive materials and may have a layer or layers other than the light-sensitive layer, for example, an antistatic layer, an electrically conductive layer, a protective layer, an intermediate layer, an antihalation layer, a strippable layer, etc.

If necessary, two or more layers may be applied at the same time by the method as described in U.S. Pat. No. 2,761,791 and British Patent No. 837,095.

The photothermographic articles of the present invention can be used to form colored images by first exposing the article to actinic radiation to provide latent silver images; then developing the exposed article by heating the exposed article to form diffusible dyes in the dry silver layers, which dyes transfer by diffusion to the image-receiving layers; and then stripping away the dry silver layers from the image-receiving layers.

In the present invention, the latent image obtained can be developed by heating the material at a moderately elevated temperature of, for example, about 80° to about 250° C., for about 0.5 second to about 300 seconds. By increasing or decreasing the heating time, the temperature may be higher or lower within the above range. Temperatures in the range of about 110° to about 160° C. are especially useful, with temperatures between about 130° and 145° C. being most preferred.

Heating may be carried out by the usual heating means such as a hot plate, an iron, a hot roller, a heat generator using carbon or titanium white, or the like.

Heating for transfer of the dyes can be effected by using the same heating means as exemplified for the heat development. To increase the quality of the dye image transferred to the dye receiving layer, it is preferred to prevent an increase in fogging by the occurrence of unnecessary development during dye transfer. For this purpose, it is especially effective to include a compound that reacts with the silver halide and/or can have the silver halide adsorbed thereon as a development stopping agent and/or an antifoggant in any one of the layers constituting the dye receiving material. Such a compound is preferably included in the dye receiving layer or a layer provided above the dye receiving layer, such as a protective layer, because it rapidly inhibits excessive development of the light-sensitive layer during transfer of the dye by heating and a sharp and clear dye image can be obtained. Such compounds include, for example, a nitrogen-containing heterocyclic compound, preferably a 5- or 6-membered heterocyclic compound containing a nitrogen atom.

The following non-limiting examples further illustrate the present invention.

EXAMPLES

Materials used in the following examples were available from commercial sources such as Aldrich Chemical Co., unless otherwise specified.

Ethyl ketazine has the formula:

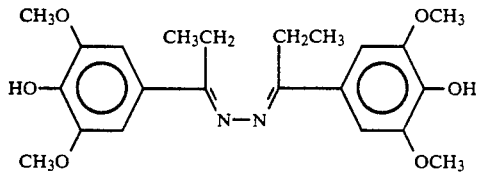

Isobutyl ketazine has the formula:

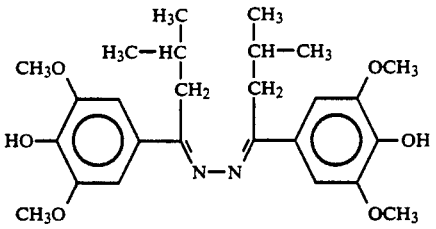

Compound A was prepared according to U.S. Pat. No. 4,123,282 and has the formula:

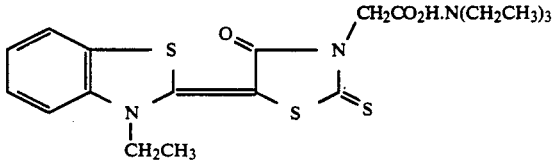

(Blue Sensitizing Dye)

Compound B has the formula:

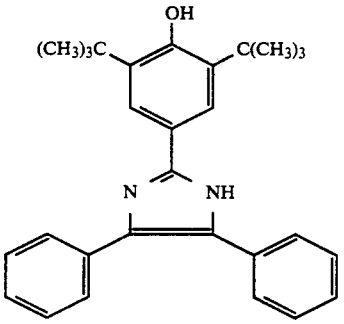

Compound C was prepared as described in U.S. Pat. No. 3,719,495 and has the formula:

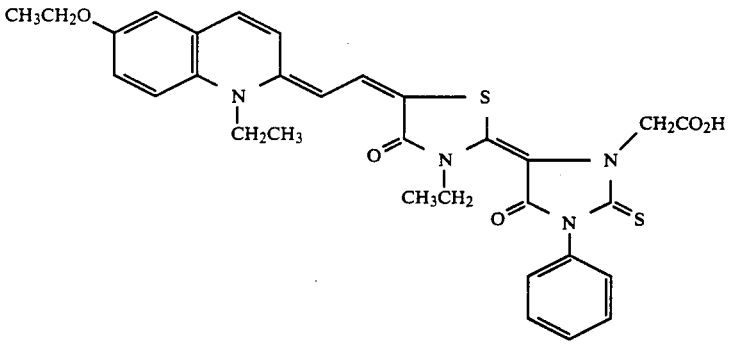

(Red Sensitizing Dye)

L704 was purchased from Hodogaya Chemical Company and has the formula:

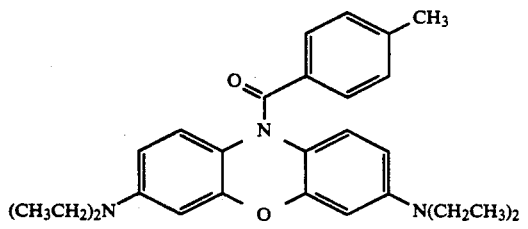

Compound D was prepared as described in U.S. Pat. No. 4,476,220 as has the formula:

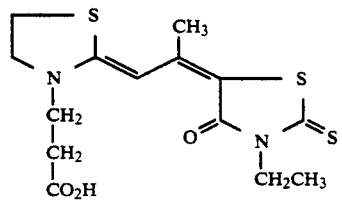

(Green Sensitizing Dye)

EXAMPLE 1

This example demonstrates the preparation of an inventive color photothermographic article.

A transparent polyethylene terephthalate film (0.076 mm thickness) was coated in successive passes with a single head knife coater. The front surface was coated with five layers as described below.

First pass: A mixture of 18 g of a 15 weight percent VYNS-3 (a 90:10 copolymer of vinyl chloride and vinyl acetate available from Union Carbide) solution in methyl ethyl ketone/toluene (1:1), 0.09 g ethyl ketazine, and 7.00 g tetrahydrofuran was coated at 3 mil wet thickness and dried 5 min. at 80° C.

Second pass: A mixture was prepared of 90.0 g of a dispersion of silver behenate half soap (1 mol silver behenate to 1 mol behenic acid, 10 percent solids in 9:1 ethanol/toluene prepared by a homogenization process), 400.0 g ethanol, 8 ml. of a solution of 0.72 g $HgBr_2$ in 40 ml methanol, 30.0 g Butvar TM B-76 (a polyvinyl butyral resin obtained from Monsanto Company, St. Louis, Mo.), and 1.5 g Fluorad TM FC 431 TM (a fluorochemical surfactant from 3M Company), in 10.0 ml ethanol. To 25.0 g of the preceding mixture was added 1.0 ml of a solution of 0.01 g compound D in 100 ml methanol. The resultant mixture was coated at 3 mil wet thickness and dried 5 minutes at 80° C.

Third pass: A mixture of 25.00 g of a 5 weight percent solution of VC106PM TM (a polyvinyl chloride resin obtained from Borden, Columbus, Ohio) and AYAF TM (a polyvinyl acetate resin obtained from Union Carbide, Danbury Conn.) as a 9:1 ratio in tetrahydrofuran, 10.00 g methyl ethyl ketone, and 0.076 g 1(2H)-phthalazinone was coated at 3 mil wet thickness and dried 5 min. at 80° C.

Fourth pass: A mixture was prepared from 205.0 g of a dispersion of silver behenate half soap (1 mol silver behenate to 1 mol behenic acid, 10 percent solids in 9:1 ethanol/toluene prepared by a homogenization process), 285.0 g ethanol, 6.0 ml of a solution of 0.72 g $HgBr_2$ in 40 ml methanol, 9.0 ml of a solution of 0.45 g $ZnBr_2$ in 20 ml methanol, 26.0 g Butvar TM B-72 (a polyvinyl butyral resin obtained from Monsanto Company, St. Louis, Mo.) and 1.0 g Fluorad TM FC 431 in 10.00 ml ethanol. To 25.0 g of the proceding mixture was added 1.00 ml of a solution of 0.02 g compound A in 100 ml methanol, 0.30 g compound B in 2.00 ml toluene and 4.00 ml methanol, and 0.24 g 1(2H)-phthalazinone dissolved in 4.00 ml methanol. The mixture was coated at 5 mil wet thickness and dried 5 minutes at 80° C.

Fifth pass: A solution was prepared containing 10 weight percent CAP TM 504-0.2 (a cellulose acetate propionate resin with a propionyl content of 41.5 percent and an acetyl content of 2.5 percent, obtained from Eastman Chemical Company) and 0.4 weight percent 1(2H)-phthalazinone in methanol, coated at 3 mil wet thickness and dried 5 minutes at 80° C.

The back surface of the film substrate was coated with four layers as described below.

First pass: A 15 weight percent solution of VYNS-3 in methyl ethyl ketone/toluene (1:1) was coated at 3 mil wet thickness and dried 5 minutes at 80° C.

Second Pass: A solution containing 13 percent Titanox TM 2160 (titanium dioxide obtained from NL Chemicals) and 11.3 percent VYNS-3 in methyl ethyl ketone/toluene (1:1) was coated at 3 mil wet thickness and dried 5 min. at 80° C.

Third pass: A mixture was prepared from 110.0 g of a dispersion of silver behenate half soap (1 mol silver behenate to 1 mol behenic acid, 10 percent solids in 9:1 ethanol/toluene prepared by a homogenization process), 380.0 g ethanol, 10.0 ml of a solution of 0.72 g $HgBr_2$ in 40 ml methanol, 26.0 g Butvar TM B-72, 1.0 g Fluorad TM FC 431 in 10.00 ml ethanol. To 25.0 g of the preceding mixture was added 1.00 ml of a solution of 0.005 g compound C in 200 ml toluene/methanol (3:1), 0.20 g L704 in 3.00 ml toluene, 0.10 g 4-methylphthalic acid, and 3.00 ml ethanol. The mixture was coated at 4 mil wet thickness and dried 5 minutes at 80° C.

Samples of the coated film were exposed for $10^{-3}$ sec. to an EG&G sensitometer through Wratten 25, 47B, and 58 filters and a 0–3 continuous density wedge. The samples were then processed in a modified 3M Brand Model 71DS heat blanket for 30 seconds at 138° C. The side with the titanium dioxide layer was toward the shoe, protected by polyethylene terephthalate film. The layers that were coated above the image-receiving layer on the front side, and the layers coated above the translucent layer on the back side were then peeled away from the image-receiving layer using SCOTCH 810 tape. Magenta, yellow, and cyan dye images were observed to have been transferred to the image-receiving layer in the areas corresponding to green, blue, and red light exposed areas, respectively, showing, good color separation. The sensitometric results obtained on a reflection densitometer, are given in Table 1. The values reported in Table 1 represent an average value resulting from 5 identical samples for each exposure.

TABLE 1

| Color | $D_{min}$ | $D_{max}$ | AC 2* | Spd 2** (ergs/cm$^2$) |
|---|---|---|---|---|
| Magenta | 0.11 | 2.07 | 5.15 | 316 |
| Yellow | 0.20 | 1.70 | 1.68 | 126 |
| Cyan | 0.30 | 1.48 | 0.47 | 1071 |

*AC 2 refers to the slope of the line joining density points of 0.60 and 1.20 above $D_{min}$ (also known in the art as γ).

**SPD 2 refers to the imaging speed corresponding to an imaged optical density of 0.60 above $D_{min}$.

EXAMPLE 2

This example demonstrates the preparation of an inventive color photothermographic article.

A transparent polyethylene terephthalate film (0.076 mm thickness) was coated in successive passes with a single head knife coater. The front surface was coated with five layers as described below.

First pass: A mixture of 18 g of a 15 percent VYNS-3 (a 90:10 copolymer of vinyl chloride and vinyl acetate available from Union Carbide) solution in methyl ethyl ketone/toluene (1:1), 0.11 g isobutyl ketazine, and 7.00 g tetrahydrofuran was coated at 3 mil wet thickness and dried 5 minutes at 80° C.

Second pass: A mixture was prepared of 90.0 g of a dispersion of silver behenate half soap (1 mol silver behenate to 1 mol behenic acid, 10 percent solids in 9:1 ethanol/toluene prepared by a homogenization process), 400.0 g ethanol, 8 ml. of a solution of 0.72 g $HgBr_2$ in 40 ml methanol, 30.0 g Butvar TM B-76, 1.5 g Fluorad TM FC 431 in 10.0 ml ethanol. To 25.0 g of the preceding mixture was added 1.0 ml of a solution of 0.01 g compound D in 100 ml methanol. The resultant mixture was coated at 3 mil wet thickness and dried 5 minutes at 80° C.

Third pass: A mixture of 25.00 g of a 5 weight percent solution of VC106PM TM /AYAF TM (90:10) in tetrahydrofuran, 10.00 g methyl ethyl ketone, and 0.076 g 1(2H)-phthalazinone was coated at 3 mil wet thickness and dried 5 minutes at 80° C.

Fourth pass: A mixture was prepared from 205.0 g of a dispersion of silver behenate half soap (1 mol silver behenate to 1 mol behenic acid, 10 percent solids in 9:1 ethanol/toluene prepared by a homogenization process), 285.0 g ethanol, 6.0 ml of a solution of 0.72 g $HgBr_2$ in 40 ml methanol, 9.0 ml of a solution of 0.45 g $ZnBr_2$ in 20 ml methanol, 26.0 g Butvar TM B-72, 1.0 g Fluorad TM FC431 in 10.00 ml ethanol. To 25.0 g of the preceding mixture was added 1.00 ml of a solution of 0.02 g compound A in 100 ml methanol, 0.30 g compound B in 2.00 ml toluene and 4.00 ml methanol, and 0.25 g 1(2H)-phthalazinone in 4.00 ml methanol. The mixture was coated at 5 mil wet thickness and dried 5 minutes at 80° C.

Fifth pass: A solution was prepared containing 10 weight percent CAP TM 504-0.2 and 0.4 percent 1(2H)-phthalazinone in methanol, coated at 3 mil wet thickness, and dried 5 minutes at 80° C.

The back surface of the film substrate was coated with four layers as described below.

First pass: A 15 weight percent solution of VYNS-3 in methyl ethyl ketone/toluene (1:1) was coated at 3 mil wet thickness and dried 5 minutes at 80° C.

Second pass: A solution containing 25 weight percent Titanox TM 2160 (titanium dioxide obtained from NL Chemicals) and 7.5 weight percent VYNS-3 in methyl ethyl ketone/toluene (1:1) was coated at 2 mil wet thickness and dried 5 minutes at 80° C.

Third pass: A mixture was prepared from 110.0 g of a dispersion of silver behenate half soap (1 mol silver behenate to 1 mol behenic acid, 10 percent solids in 9:1 ethanol/toluene prepared by a homogenization process), 380.0 g ethanol, 10.0 ml of a solution of 0.72 g $HgBr_2$ in 40 ml methanol, 26.0 g Butvar TM B-72, 2.0 g Fluorad TM FC431 in 10.00 ml ethanol. To 25.0 g of the preceding mixture was added 1.00 ml of a solution of 0.005 g compound C in 200 ml toluene/methanol (3:1), 0.25 g L704 in 3.00 ml toluene. The mixture was coated at 4 mil wet thickness and dried 5 minutes at 80° C.

Fourth pass: A mixture of 15.00 g of a 15 percent solution of CAP TM 504-0.2 in methanol/2-propanol (4:1), 0.008 g benzotriazole, 0.150 g 4-methylphthalic acid in 3 ml ethanol was coated at 3 mil wet thickness and dried 5 minutes at 80° C.

Samples of the coated film were exposed for $10^{-3}$ sec. to an EG&G sensitometer through Wratten 25, 47B, and 58 filters and a 0–3 continuous density wedge. The samples were then processed in a modified 3M Brand Model 71DS heat blanket for 30 seconds at 138° C. The side with the titanium dioxide layer was toward the shoe. The layers that were coated above the image-receiving layer on the front, and the layers coated above the translucent layer on the back were then peeled away from the image-receiving layer using SCOTCH 810 tape. Magenta, yellow, and cyan dye images were observed to have been transferred to the image-receiving layer in the areas corresponding to green, blue, and red light exposed areas, respectively, showing good color separation. The sensitometric results, obtained on a reflection densitometer, are given in Table 2. The values reported in Table 2 represent an average value resulting from 5 identical samples for each exposure.

TABLE 2

| Color | $D_{min}$ | $D_{max}$ | AC 2* | SPD 2** (ergs/cm$^2$) |
|---|---|---|---|---|
| Magenta | 0.10 | 1.98 | 3.03 | 63 |
| Yellow | 0.18 | 1.77 | 0.85 | 14 |
| Cyan | 0.25 | 1.57 | 1.44 | 550 |

*AC 2 refers to the slope of the line joining density points of 0.60 and 1.20 above $D_{min}$ (also known in the art as $\gamma$).
**SPD 2 refers to the imaging speed corresponding to an imaged optical density of 0.60 above $D_{min}$.

EXAMPLES 3-6

These examples demonstrate the importance of thickness and density of the inorganic pigment in the translucent pigment layer used in the imageable articles of the present invention. The absorbance of the film measured on a transmission spectrophotometer indicated that a reflection print was obtained in each instance. A 0.076 mm thickness polyethylene terephthalate film substrate was coated with four layers as described below.

First pass: A 15 percent solution of VYNS-3 in methyl ethyl ketone/toluene (1:1) was coated at 3 mil wet thickness and dried 5 minutes at 80° C.

Second Pass: A solution containing Titanox TM 2160 (titanium dioxide obtained from NL Chemicals) VYNS-3, and surfactants in methyl ethyl ketone/toluene (1:1) was prepared according to the amounts shown in Table 3 and coated at 3 mil wet thickness and dried 5 minutes at 80° C.

Third pass: A mixture was prepared from 110.0 g of a dispersion of silver behenate half soap (1 mol silver behenate to 1 mol behenic acid, 10 percent solids in 9:1 ethanol/toluene prepared by a homogenization process), 380.0 g ethanol, 10.0 ml of a solution of 0.72 g $HgBr_2$ in 40 ml methanol, 26.0 g Butvar TM B-72, 1.0 g Fluorad TM FC 431 in 10.00 ml ethanol. To 25.0 g of the preceding mixture was added 1.00 ml of a solution of 0.005 g compound C in 200 ml toluene/methanol (3:1), 0.20 g L704 in 3.00 ml toluene, and 3.00 ml methanol. The mixture was coated at 4 mil wet thickness and dried 5 minutes at 80° C.

Fourth pass: A mixture of 75.0 g CAP 504-0.2, 340.0 g methanol, 85.0 g isopropanol, 5.0 g 4-methyl phthalic acid, and 0.27 g benzotriazole was coated at 3.0 mil wet thickness and dried 5 minutes at 80° C.

The following layers were employed in place of those used in Example 1. Hypermer TM PS3 and Hypermer TM B246 are polymeric surfactants obtained from ICI Specialty Chemicals, Wilmington, Del.

TABLE 3

| | Example 3 10% $TiO_2$ | Example 4 12.5% $TiO_2$ | Example 5 15.0% $TiO_2$ | Example 6 20.0% $TiO_2$ |
|---|---|---|---|---|
| Titanox TM 2160 | 33.3 g | 42.9 g | 52.9 g | 75.0 |
| VYNS TM 3 | 45.0 g | 45.0 g | 45.0 g | 45.0 |
| Hypermer TM PS3 | 1.0 g | 1.3 g | 1.6 g | 2.25 |
| Hypermer TM B246 | 1.7 g | 2.1 g | 2.6 g | 3.75 |
| methyl ethyl ketone | 127.5 g | 127.5 g | 127.5 g | 127.5 |
| toluene | 127.5 g | 127.5 g | 127.5 g | 127.5 |
| total weight | 336.0 g | 346.3 g | 357.1 g | 381.0 |

Sensitometric results from a reflection densitometer are shown in Table 4.

TABLE 4

| Example | Coating Thickness | Viewing Side (front) $D_{min}$ | $D_{max}$ | Absorbance |
|---|---|---|---|---|
| 3 | 2 mil | 0.23 | 1.97 | 0.45 |
| | 3 mil | 0.20 | 1.51 | 0.52 |
| | 4 mil | 0.18 | 1.12 | 0.57 |
| 4 | 2 mil | 0.24 | 1.88 | 0.46 |
| | 3 mil | 0.21 | 1.27 | 0.57 |
| | 4 mil | 0.18 | 0.86 | 0.65 |
| 5 | 2 mil | 0.23 | 1.76 | 0.51 |
| | 3 mil | 0.21 | 1.35 | 0.54 |
| | 4 mil | 0.16 | 0.60 | 0.69 |
| 6 | 2 mil | 0.18 | 1.23 | 0.56 |
| | 3 mil | 0.14 | 0.64 | 0.64 |
| | 4 mil | 0.13 | 0.37 | 0.75 |

Reasonable modifications and variations are possible from the foregoing disclosure without departing from either the spirit or scope of the present invention as defined in the claims.

What is claimed is:

1. A photothermographic element comprising a transparent substrate having first and second major substrate surfaces, wherein said first major substrate surface comprises the following layers sequentially coated thereon: an image-receiving layer; a strippably adhered dry silver layer; an interlayer; and a second dry silver layer; and wherein said second major substrate surface comprises the following layers sequentially coated thereon: an image-receiving layer; a translucent layer; and a third dry silver layer, wherein: (a) said first, second, and third dry silver layers each comprise a light-insensitive, reducible silver source; light-sensitive silver halide; and reducing agent for said light-insensitive, reducible silver source; and (b) each of said dry silver layers is individually sensitized to light of different wavelengths and wherein each of said dry silver layers comprises a material oxidizable to a colored dye whose color differs from that capable of being formed in each other dry silver layer.

2. The photothermographic element according to claim 1 wherein said light-insensitive, reducible silver source comprises a $C_{10}$–$C_{30}$ aliphatic carboxylic acid.

3. The photothermographic element according to claim 2 wherein said light-sensitive silver halide comprises silver bromide, silver chloride, silver iodide, or mixtures thereof.

4. The photothermographic element according to claim 1 wherein said light-insensitive, reducible silver source is present in each of said dry silver layers in an amount of from about 5 to 70 weight percent.

5. The photothermographic element according to claim 1 wherein said light-sensitive silver halide is present in each of said dry silver layers in an amount of from about 0.01 to 15 weight percent.

6. The photothermographic element according to claim 1 wherein said reducing agent comprises leuco dye.

7. The photothermographic element according to claim 1 wherein said reducing agent is present in each of said dry silver layers in an amount of from about 1 to 20 weight percent.

8. The photothermographic element according to claim 1 wherein said translucent layer comprises titanium dioxide.

9. The photothermographic element according to claim 1 wherein each of the coated first and second major substrate surfaces are coated on the outside with a protective layer.

10. The photothermographic element according to claim 1 wherein said third dry silver layer is strippably adhered.

11. A photothermographic element comprising a transparent substrate having first and second major substrate surfaces, wherein said first major substrate surface comprises the following layers sequentially coated thereon: an image-receiving layer; and a strippably adhered first dry silver layer; and wherein said second major substrate surface comprises the following layers sequentially coated thereon: an image-receiving layer; a translucent layer; a second dry silver layer; an interlayer; and a third dry silver layer, wherein: (a) said first, second, and third dry silver layers each comprise a light-insensitive, reducible silver source; light-sensitive silver halide; and reducing agent for said light-insensitive, reducible silver source; and (b) each of said dry silver layers is individually sensitized to light of different wavelengths and wherein each of said dry silver layers comprises a material oxidizable to a colored dye whose color differs from that capable of being formed in each other dry silver layer.

12. The photothermographic element according to claim 11 wherein said light-insensitive, reducible silver source comprises a $C_{10}$–$C_{30}$ aliphatic carboxylic acid.

13. The photothermographic element according to claim 12 wherein said light-sensitive silver halide comprises silver bromide, silver chloride, silver iodide, or mixtures thereof.

14. The photothermographic element according to claim 9 wherein said light-insensitive, reducible silver source is present in each of said dry silver layers in an amount of from about 5 to 70 weight percent.

15. The photothermographic element according to claim 9 wherein said light-sensitive silver halide is present in each of said dry silver layers in an amount of from about 0.01 to 15 weight percent.

16. The photothermographic element according to claim 9 wherein said reducing agent comprises leuco dye.

17. The photothermographic element according to claim 9 wherein said reducing agent is present in each of said dry silver layers in an amount of from about 1 to 20 weight percent.

18. The photothermographic element according to claim 11 wherein said translucent layer comprises titanium dioxide.

19. The photothermographic element according to claim 11 wherein each of the coated first and second major substrate surfaces are coated on the outside with a protective layer.

20. The photothermographic element according to claim 11 wherein said second dry silver layer is strippably adhered.

21. A process for making a reflection print comprising the steps of: (a) exposing the photothermographic element of claim 1 to actinic light; (b) heating the exposed photothermographic element for image development and transfer; and (c) stripping the strippably adhered dry silver layers from the image-receiving layer of the exposed photothermographic element.

22. A process for making a reflection print comprising the steps of: (a) exposing the photothermographic element of claim 11 to actinic light; (b) heating the exposed photothermographic element for image development and transfer; and (c) stripping the strippably adhered dry silver layer from the image-receiving layer of the exposed photothermographic element.

* * * * *